US005448834A

United States Patent [19]

Huang

[11] Patent Number: 5,448,834

[45] Date of Patent: Sep. 12, 1995

[54] TELESCOPE SIGHT COLLIMATING DEVICE

[75] Inventor: Chao C. Huang, Taipei, Taiwan

[73] Assignee: Quarton Inc., Taipei, Taiwan

[21] Appl. No.: 352,921

[22] Filed: Dec. 9, 1994

[51] Int. Cl.[6] ..... F41G 1/54

[52] U.S. Cl. ..... 33/234; 33/DIG. 21; 279/2.12

[58] Field of Search ..... 33/234, DIG. 21; 279/2.03, 2.12

[56] References Cited

U.S. PATENT DOCUMENTS

| | | | |
|---|---|---|---|
| 2,476,981 | 7/1949 | Horton | 33/234 X |
| 4,825,258 | 4/1989 | Whitson | 33/234 X |
| 5,150,527 | 9/1992 | Knoster | 33/234 |

*Primary Examiner*—Alvin Wirthlin
*Attorney, Agent, or Firm*—Merchant, Gould, Smith, Edell, Welter & Schmidt

[57] ABSTRACT

A telescope sight collimating device including a laser aimer, a longitudinal center axle at one end of the aimer sleeved with a split sleeve and threadably engaged with a lock nut at its free end for positioning the device in the barrel of the gun, a tapered tubular locating rod and a tapered tubular tightening up rod respectively mounted around the longitudinal center axle and engaging both ends of the split sleeve, and an adjusting nut mounted around the longitudinal center axle and turned in either direction to move the tapered tubular tightening up rod forward or backward, causing the sleeve to be fixed to or released from the inside wall of the barrel of the gun.

2 Claims, 7 Drawing Sheets

TELESCOPE SIGHT COLLIMATING DEVICE

BACKGROUND OF THE INVENTION

The present invention relates to an optical collimating apparatus, and relates more particularly to a collimating device for mounting on a gun to collimate the telescope sight.

During target-shooting, the telescope sight of the gun must be accurately aligned by adjusting the windage & elevation adjustment knobs. When adjustment of the telescope sight is done, a trial shooting is made to check the accuracy of the adjustment. If the adjustment is not accurate, then the position of the telescope sight must be adjusted again. Therefore, several adjustments may be needed before the telescope sight is accurately aligned. This complicated procedure wastes a lot of time.

SUMMARY OF THE INVENTION

The present invention has been accomplished under the above circumstances. It is therefore the principal object of the present invention to provide a telescope sight collimating device which can be conveniently concentrically mounted in the barrel of a gun to collimate the telescope sight accurately.

According to one aspect of the present invention, the telescope sight collimating device comprises a laser aimer, which has a longitudinal center axle at one end sleeved with a split sleeve and fixed in place with a lock nut for positioning in the barrel of the gun, a tapered tubular locating rod and a tapered tubular tightening up rod respectively mounted around the longitudinal center axle and engaging both ends of the split sleeve, and an adjusting nut mounted around the longitudinal center axle and turned in either direction to move the tapered tubular tightening up rod forward or backward, causing the sleeve to be fixed to or released from the inside wall of the barrel of the gun. When the laser aimer is triggered to emit a laser beam onto the center point of the target, the telescope sight is adjusted to aim its center point at the light spot of the laser beam on the target. When the light spot of the laser beam and the center point of the telescope sight are aligned, the collimation is done.

According to another aspect of the present invention, both ends of the sleeve have respective longitudinal splits; therefore, both ends may be expanded radially to stop against the inside wall of the barrel of the gun when the tapered tubular tightening up rod is driven into the sleeve toward the tapered tubular locating rod by the adjusting nut, causing the collimating device to be firmly retained in the barrel of the gun. When the tapered tubular tightening up rod is moved backward from the sleeve, the split ends of the sleeve immediately return to their former shapes and are released from the inside wall of the barrel, and therefore the collimating device can be coveniently removed from the barrel of the gun.

DETAILED DESCRIPTION OF THE PREFERRED EMBODIMENT

Figure 1:
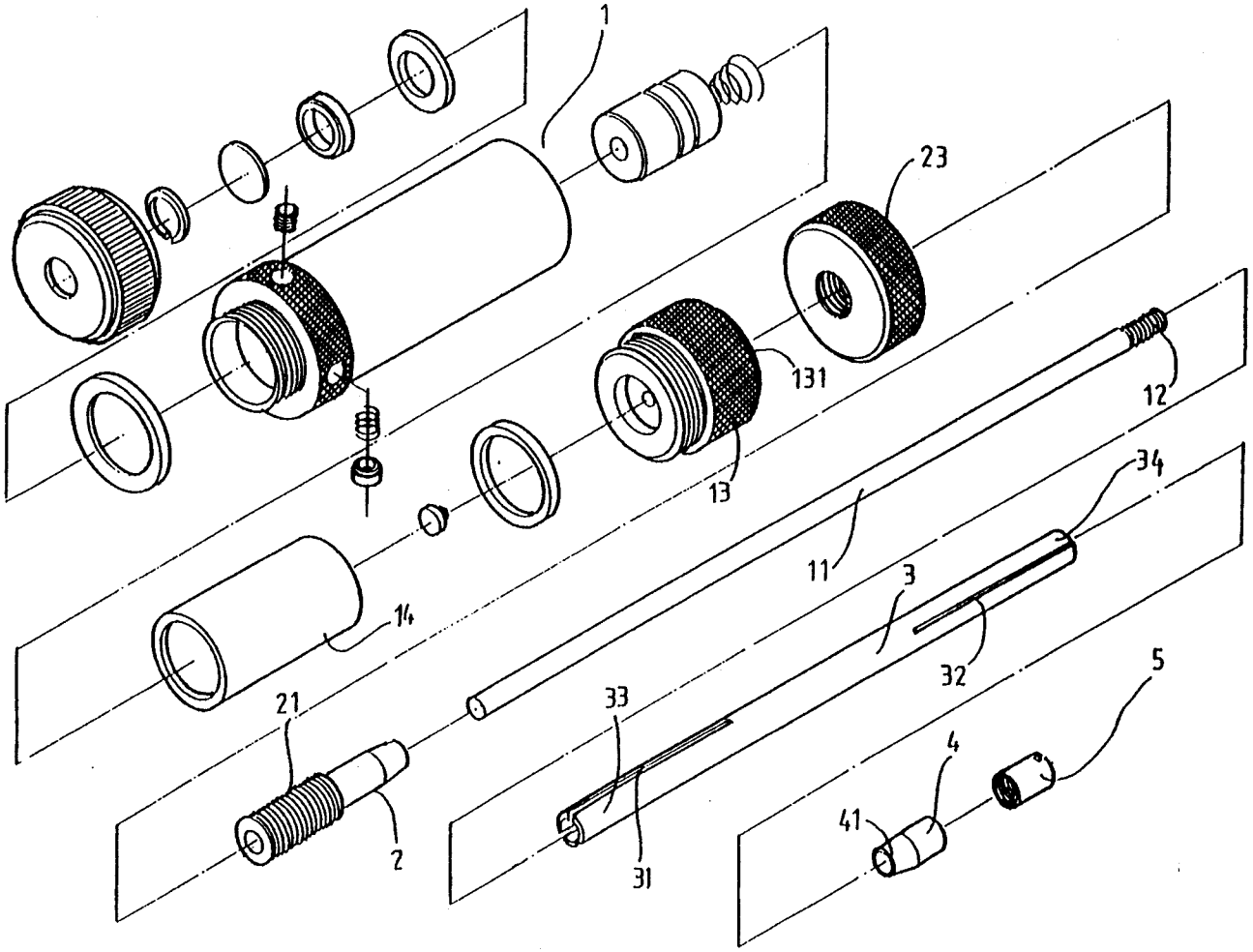
FIG. 1 is an exploded perspective view of a collimating device according to the present invention.
Figure 2:
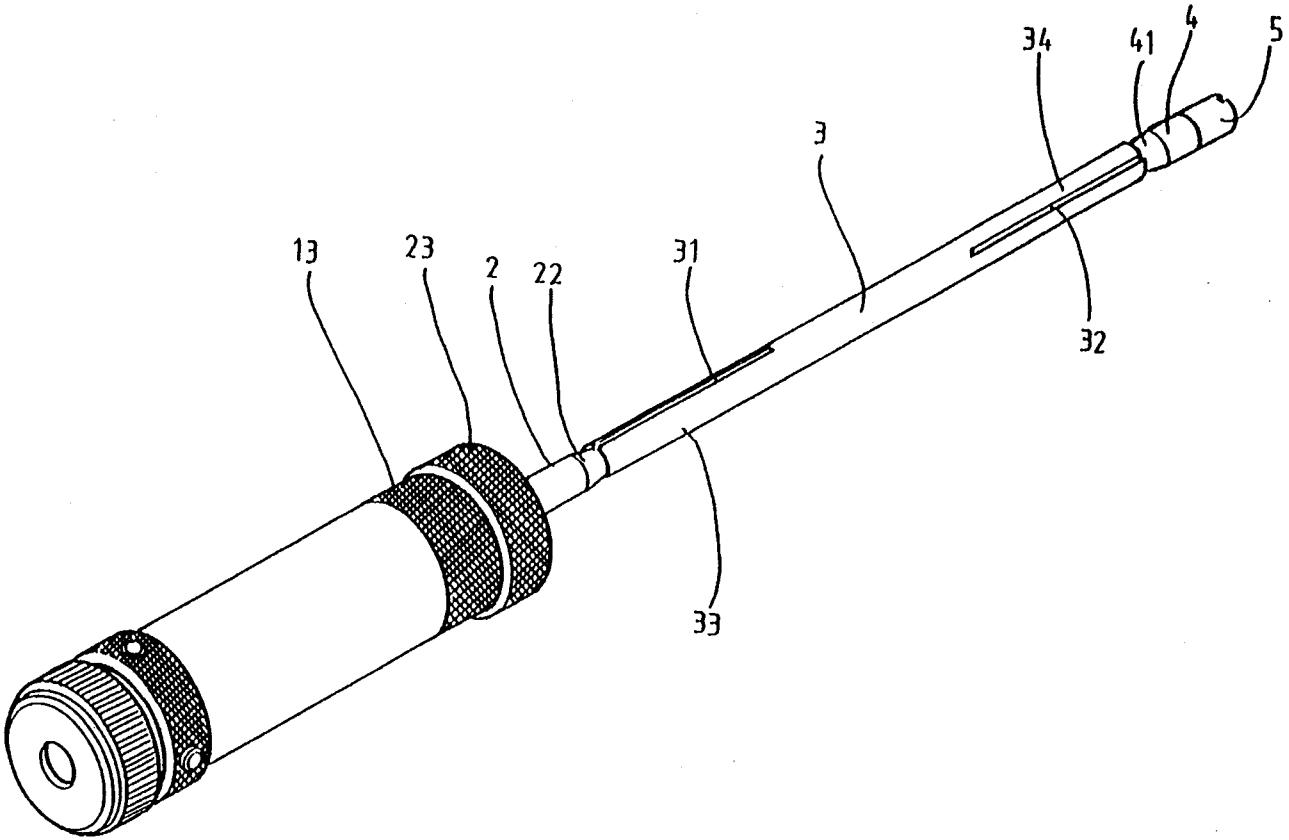
FIG. 2 is a perspective view of the collimating device shown in FIG. 1 when assembled.
Figure 3:
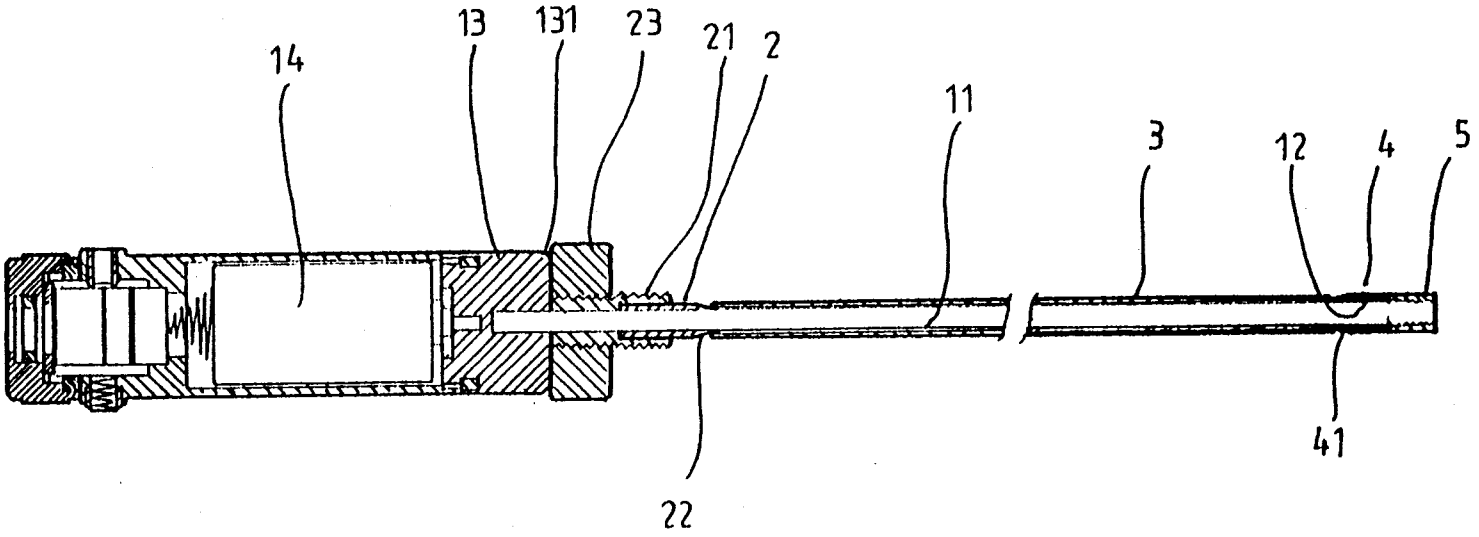
FIG. 3 is a longitudinal view in section of FIG. 2.

Referring to FIGS. 1, 2, and 3, a collimating device in accordance with the present invention is generally comprised of a laser aimer 1, a tubular tightening up rod 2, a sleeve 3, a tubular locating rod 4, and a lock nut 5. The laser aimer 1 is covered with a back cover 13 to hold a battery 14 on the inside. A longitudinal center axle 11 extends out of a center through hole (not shown) of the back cover. The longitudinal center axle 11 terminates in a threaded portion of screw rod 12 which threadably engages with the lock nut 5. The tubular tightening up rod 2, which is sleeved onto the longitudinal center axle 11, having an outer thread 21 at one end threadably engaged with an adjusting nut 23 and a tapered portion 22 at an opposite end. The tubular locating rod 4 is sleeved onto the longitudinal center axle 11 adjacent the lock nut 5 and includes a tapered portion 41 at one end. The sleeve 3 is sleeved onto the longitudinal center axle 11, and includes longitudinal splits 31 and 32 formed in both ends 33 and 34. When assembled, the tapered portions 22 and 41 respectively fit into the two opposite ends 33 and 34 of the sleeve 3.

Figure 4:
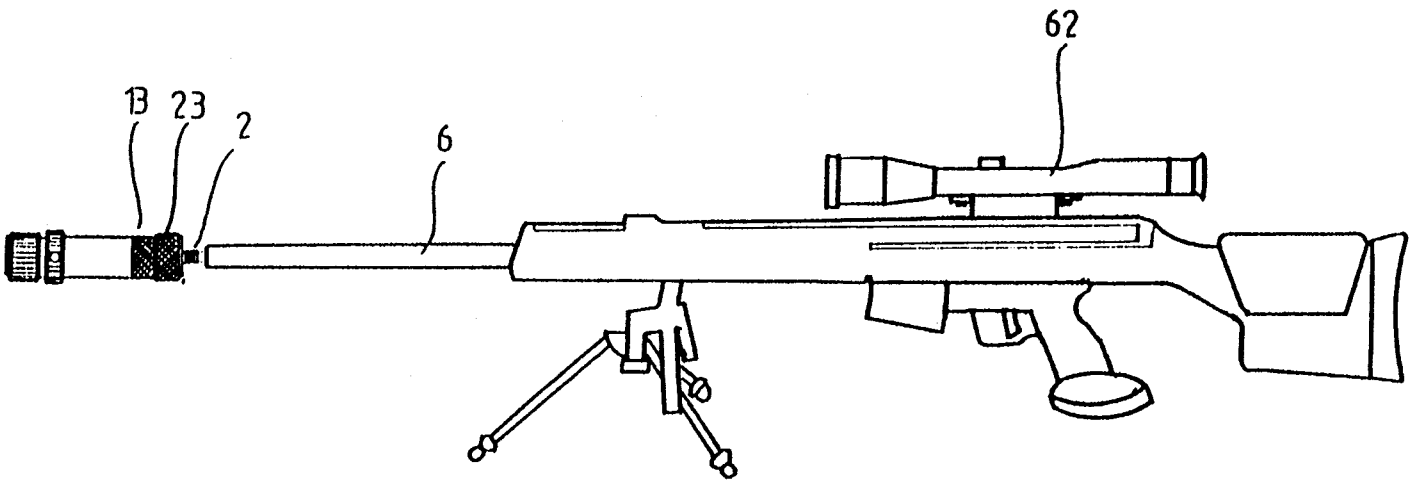
FIG. 4 is an applied view of the present invention, showing the collimating device installed in the barrel of a gun.
Figure 5:
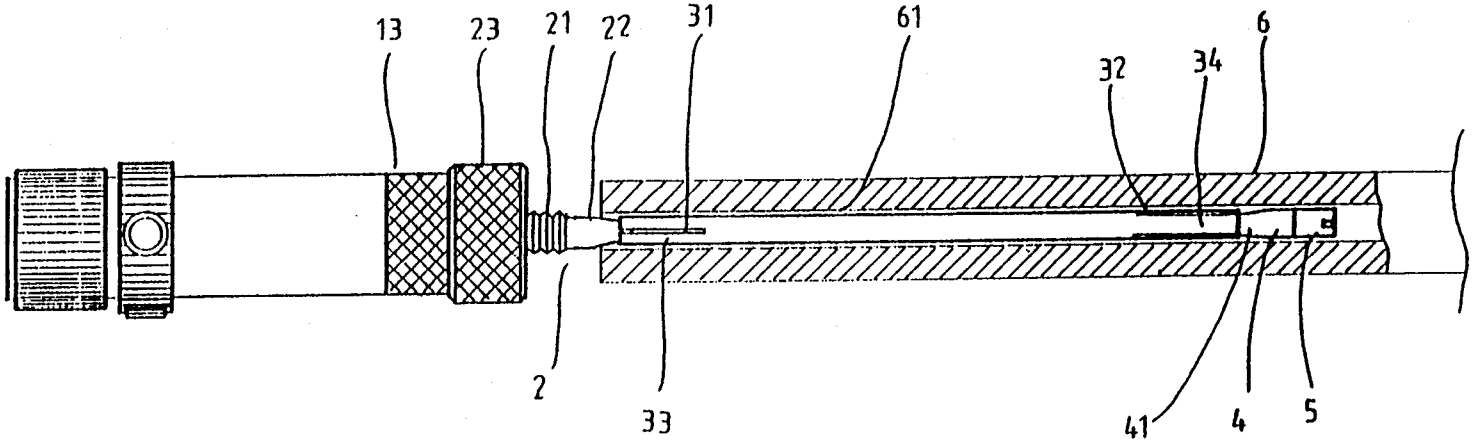
FIG. 5 is a sectional view in an enlarged scale of the device installed in the gun barrel as shown in FIG. 4.
Figure 6:
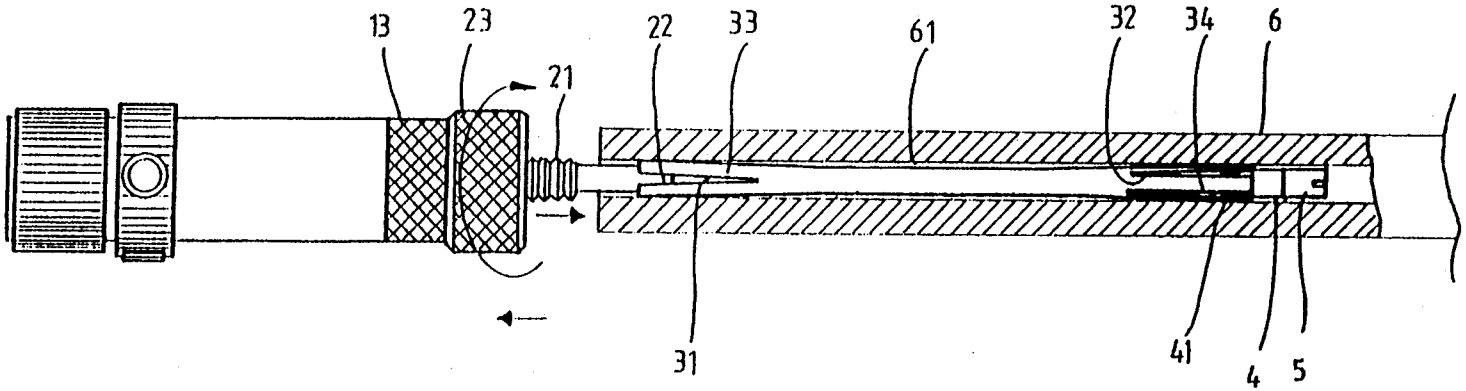
FIG. 6 is similar to FIG. 5 but showing the adjusting nut turned forward and the tubular tightening up rod moved toward the tubular locating rod.

Referring to FIGS. 4, 5, and 6, when the end of the device includes the lock nut 5 with the tubular locating rod 4 and the sleeve 3 is inserted into the barrel 6 of a gun, the adjusting nut 23 is turned forward, causing the tubular tightening up rod 2 to move toward the barrel 6, and therefore the distance between the tapered portions 22 and 41 is relatively reduced. When the tapered portion 22 of the tubular tightening up rod 2 is moved toward the tapered portion 41 of the tubular locating rod 4, the two split ends 33 and 34 of the sleeve 3 are expanded radially and forced against the inside wall 61 of the barrel 6, causing the sleeve 3 and the barrel 6 to be firmly retained together. When the collimating device is fixed in the barrel 6, the laser aimer 1 of the collimating device is triggered to emit a laser beam onto the center point of the target, and then the telescope sight 62 of the gun is adjusted to focus onto the light spot of the laser beam on the target.

Figure 7:
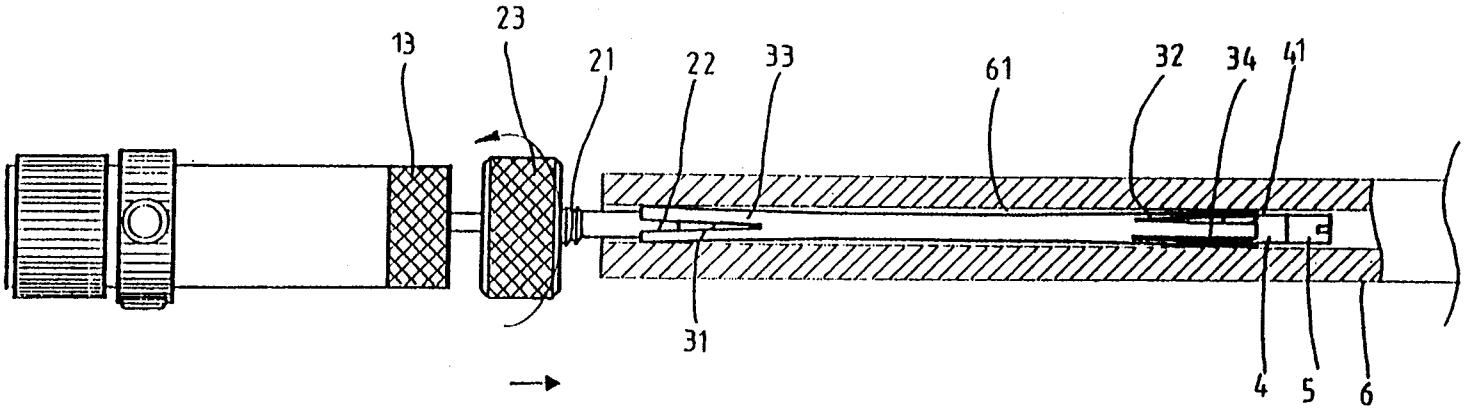
FIG. 7 is similar to FIG. 5 but showing the adjusting nut turned in the opposite direction and the tubular tightening up rod moved from the sleeve.
Figure 8:
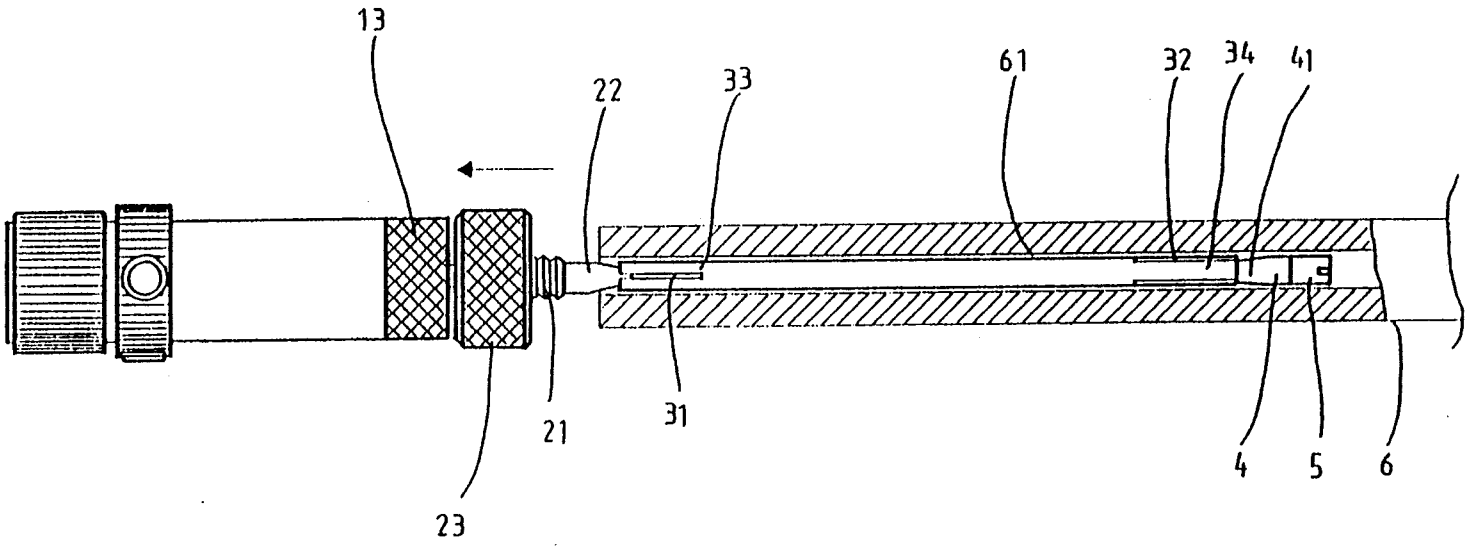
FIG. 8 is similar to FIG. 7 but showing the sleeve released from the inside wall of the barrel.

Referring to FIGS. 7 and 8, after collimation, the adjusting nut 23 is turned in the opposite direction to move the tubular tightening up rod 2 out of the end 33 of the sleeve 3, causing the sleeve 3 to be released from the inside wall 61 of the barrel 6, and therefore the collimating device may be removed from the barrel 6 of the gun.

Referring to the annexed drawings again, because the longitudinal central axis of the sleeve 3 and the longitudinal central axis of the longitudinal center axle 11 coincide with each other, the longitudinal central axis of the collimating device does not change when the sleeve 3 is expanded radially.

While only one embodiment of the present invention has been shown and described, it will be understood that various modifications and changes could be made without departing from the spirit and scope of the invention.

What is claimed is:

1. A telescope sight collimating device for fastening to the barrel of a gun for collimating the telescope sight of the gun, the collimating device comprising a laser aimer controlled to emit a laser beam for collimating and having a longitudinal center axle extended from a rear end thereof, said longitudinal center axle having one end connected to said laser aimer and an opposite end terminating in a screw rod screwed up with a lock nut, an adjusting nut mounted around said longitudinal center axle and disposed adjacent to said laser aimer, a sleeve sleeved onto said longitudinal center axle and driven to hold said longitudinal center axle in the barrel of a gun, a tubular tightening up rod mounted around said longitudinal center axle, said tubular tightening up rod having an outer thread at one end threaded into said adjusting nut and a tapered portion at an opposite end fitted into one end of said sleeve, and a tubular locating rod mounted around said longitudinal center axle, said tubular locating rod having one end stopped against said lock nut and an opposite end terminating in a tapered portion fitted into an opposite end of said sleeve, and wherein turning said tubular tightening up rod in one direction causes said sleeve to be firmly stopped against the inside wall of the barrel of the gun to hold the collimating device in position; turning said tubular tightening up rod in the opposite direction causes said sleeve to be released from the inside wall of the barrel of the gun for allowing the collimating device to be removed from the barrel of the gun.

2. The telescope sight collimating device of claim 1 wherein said sleeve has a plurality of longitudinal splits at each end.

* * * * *